United States Patent [19]

Salmi

[11] 4,366,868

[45] Jan. 4, 1983

[54] ROCK DRILL APPARATUS

[75] Inventor: Pekka Salmi, Tampere, Finland

[73] Assignee: Oy Tampella AB, Tampere, Finland

[21] Appl. No.: 36,652

[22] Filed: May 7, 1979

[30] Foreign Application Priority Data

May 11, 1978 [FI] Finland ..... 781486

[51] Int. Cl.[3] ..... B25D 9/00

[52] U.S. Cl. ..... 173/105; 173/90; 173/132

[58] Field of Search ..... 173/90, 132, 133, 131, 173/114, 104, 105

[56] References Cited

U.S. PATENT DOCUMENTS

| | | | |
|---|---|---|---|
| 1,080,095 | 12/1913 | Bayles | 173/133 X |
| 2,083,261 | 6/1937 | Gray | 173/133 X |
| 2,226,559 | 12/1940 | Groom | 173/133 X |
| 3,583,499 | 6/1971 | Condes | 173/131 |
| 3,625,295 | 12/1971 | Gunning | 173/133 X |
| 3,827,507 | 8/1974 | Lance . | |
| 4,109,734 | 8/1978 | Montabert | 173/131 X |
| 4,206,820 | 6/1980 | Bailey et al. | 173/105 |

FOREIGN PATENT DOCUMENTS

| | | | |
|---|---|---|---|
| 475805 | 5/1929 | Fed. Rep. of Germany | 173/133 |
| 763159 | 3/1981 | Finland . | |
| 325239 | 7/1968 | Sweden . | |

*Primary Examiner*—Werner H. Schroeder

*Assistant Examiner*—Andrew M. Falik

*Attorney, Agent, or Firm*—Hill, Van Santen, Steadman, Chiara & Simpson

[57] ABSTRACT

A striking apparatus that includes a reciprocating striking piston operable by a pressure mechanism, a cylindrical body, the improvement comprising a sleeve bushing mounted inside of the cylindrical body in slidably fitted assembly therewith. The sleeve bushing has a drive gear at one end for rotary engagement with a drive motor. A rotary tool and piston shank and piston are all integrally combined as a one piece unit and at least partly received in coaxial alignment within the tubular bushing. Spline gearage exists between the tubular bushing and the piston shank enabling co-rotational rotary movement together upon actuation of the drive gear through operation of a drive motor operatively connected therewith. A piston cylinder in the cylindrical body along with the piston is reciprocably movable in the piston cylinder. The shank has a shank face facing in the direction opposing the striking piston and with the shank face transferring the feed force from the body through the sleeve bushing to the rotary tool. There is structure cooperable with the piston cylinder for assisting a pressure medium to be directed towards the front of the piston so that the latter moves backwards towards the striking piston causing a striking contact between an end surface of the shank and the striking piston when the tool becomes stuck.

2 Claims, 4 Drawing Figures

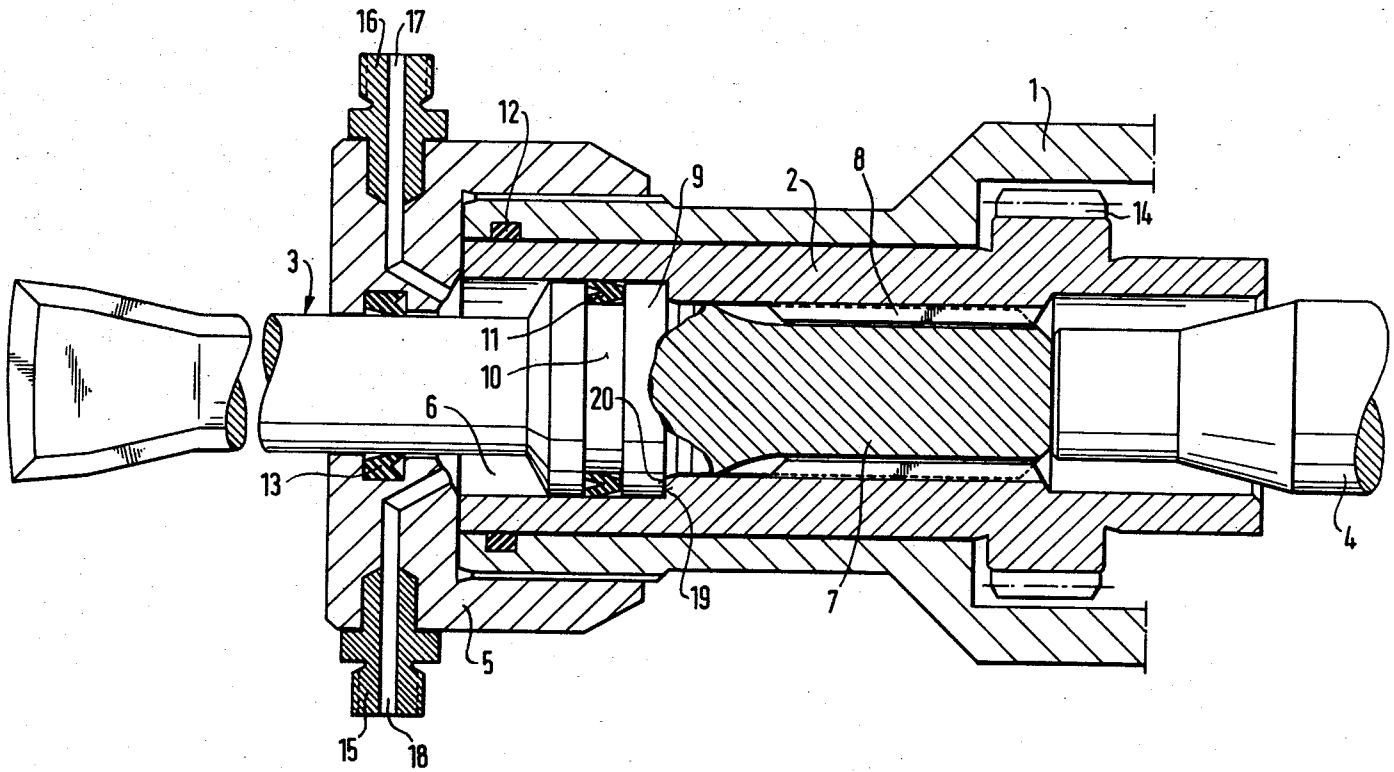
1
2
3
4
5
6
7
8
9
10
11
12
13
14
15
16
17
18
19
20

ROCK DRILL APPARATUS

This invention relates to a striking apparatus including a body, means defining a piston cylinder in the body, a reciprocating striking piston in the piston cylinder operable by a pressure medium, a tool attached to the body and having a shank with a shank face facing in the direction of the striking piston for transferring the striking energy from the striking piston to the tool, and a shank cylinder having shank piston means for causing a striking contact between the shank face and the striking piston by a pressure medium directed towards the front of the shank piston so that it moves backwards towards the striking piston when the striking apparatus is pulled backwards.

As an example, this kind of striking apparatus is usable in a rock drill. The striking apparatus, when embodied in a rock drill, is moved towards the drilling object manually or by a feed motor. When drilling into fissured rock there is a risk that the tool may get stuck. When this happens the rotation stops and the rotation resistance increases strongly. The sticking is normally prevented by changing the direction of feed when the rotation resistance reaches a preset limit. In order to loosen the already stuck tool the feed movement is reversed. A percussion machine is known, as seen in U.S. Pat. No. 4,109,734, in which the releasing of the tool can be improved by moving the tool into striking contact with the striking piston by means of a shank cylinder which is connected to the shank of the tool, whereby the tool can be shaken free by means of the strokes of the striking piston during the backwards movement of the apparatus. Thus, the tool can be released by a lighter backwards movement force. In this known apparatus the piston which causes the striking contact between the striking piston and the tool is a separate component and it is pierced by the tool rod and has an effect upon the same.

This construction of the shank cylinder is bukly and it is difficult to manufacture because of the sliding tolerances between the tool rod and shank piston and between the shank piston and shank cylinder in the body and the counter surface arrangement between the shank piston and the tool rod which passes through the piston, and because the cylinder space is defined by two separate cylinder surfaces and requires two sliding packings between the cylinder and the piston.

The object of this invention is to avoid the abovementioned disadvantages and to achieve a striking apparatus which is simpler and more reliable in operation.

It is therefore an important object of this invention to provide a striking apparatus where the shank piston in the shank cylinder is an integral part of the tool and arranging the face of the shank piston to act as a support face to transfer the feed force from the body of the apparatus to the tool.

The invention will be described with reference to the accompanying drawings in which:

FIG. 1 is a longitudinal sectional view of the front end of the striking apparatus embodying the principles of the present invention;

FIG. 2 is a cross-sectional view of the front end of the striking apparatus shown in FIG. 1 as viewed on the line II—II;

FIG. 3 is a longitudinal sectional view of the tool by itself; and

FIG. 4 shows a side view of the striking apparatus of FIG. 1 showing it mounted on a conventional feed device.

The general construction of a striking apparatus is known to a person familiar with the art and therefore it will not be described in more detail. In this application "forward" means the drilling direction and "backward" means the opposite direction.

In a preferable embodiment of the invention in FIG. 1 the striking apparatus comprises a body 1 and a tubular sleeve bushing 2 to which a tool 3 is attached. The striking piston 4 is moved to and fro by a pressure medium. In the front end of the body 1 there is a cover 5 in which there is an opening for the tool 3. Behind the cover, in the front end of the sleeve bushing 2, there is a closed cylinder space 6, which is sealed by packings 12 and 13. At the rear end of the tool 3 there is a shank 7 and the collar in front of the shank 7. This collar acts as a shank piston 9 in the shank cylinder. The shank piston 9 is an integral part of the tool 3. In the groove 10 in the shank piston 9 there is a packing 11. The shank piston 9 moves in the cylinder space 6. In the cover 5 are adapters 15 and 16. In the adapteers and in the cover are channels 17 and 18 to lead pressure medium into and out of the cylinder space 6. The channels 17 and 18 can be replaced with only one channel when using a suitable valve arrangement in the channel. The face 19 of the shank piston 9 directed towards the striking piston is a support face which leans against the ring shoulder 20 of the bushing 2.

The rotation of the tool 3 is caused by a rotation motor 21 through the gear 14 of the bushing 2 and through splines 8 of the bushing 2 and the shank 7.

In FIG. 2, the shank 7 of the tool 3 is attached to the sleeve bushing 2 so that the sleeve bushing can transfer the rotating movement to the tool through the splines.

In FIG. 3, the shank piston 9 and the shank 7 are an integral part of the tool 3 and the splines 8 are machined in the shank.

In FIG. 4, the novel striking apparatus is mounted on a conventional feed device.

The feed device which is connected to a boom 30 includes a frame 31, a carriage 33 slidable mounted on the frame 31, a feed motor 36, a feed chain 37, means for guiding the chain 37, means for guiding the carriage 33 and a guide 38 for the tool 3.

The apparatus 32 is mounted on the carriage 33. A feed motor 36 moves the carriage with the striking apparatus with a chain 37 along the frame 31 towards the object of the work.

In operation, the striking apparatus is fed towards the object of work by pushing the body forward. The body pushes the sleeve bushing 2, which pushes the tool 3 through the faces 20 and 19 of the bushing 2 and shank piston 9. Thus, the shank 7 is brought into striking contact with striking piston 4 for drilling.

The feed force can be caused by a person, who is manually pushing the drilling apparatus and especially its body 1 or a commonly known feed device, which is connected to the body 1. When loosening the tool 3 when stuck, the cylinder 6 and its channels 17 and 18 are utilized. The cylinder 6 is filled with a pressure medium through one of the channels 17 or 18. When the striking apparatus is now pulled backwards, the pressure prevailing in the cylinder 6 pushes the shank piston 9 again into engagement with the ring shoulder 20 of the bushing 2 maintaining the shank 7 in striking contact with the piston 4.

By operating the striking apparatus the loosening of the tool can now be more readily brought about by effectively striking the shank 7 at the same time when the striking apparatus is being pulled backwards. The simultaneous pulling of the apparatus and striking creates a pressure cushion in the cylinder 6, the cushion causing a negative backwards impact on the tool 3. The striking effect on the tool also breaks rock in which the tool is sticking and thus it helps to release the tool.

I claim:

1. In a striking apparatus including a reciprocating striking piston operable by a pressure mechanism, a cylindrical body, the improvement comprising a sleeve bushing mounted inside of the cylindrical body in slidably fitted assembly therewith, the sleeve bushing having a drive gear at one end for rotary engagement with a drive motor, a rotary tool and piston shank and piston all integrally combined as a one piece unit and at least partly received in coaxial alignment within said tubular bushing, spline gear means between the tubular bushing and the piston shank enabling co-rotational rotary movement together upon actuation of the drive gear through operation of a drive motor operatively connected therewith, means defining a piston cylinder in the cylindrical body and with the piston being reciprocably movable in the piston cylinder, the shank having a shank face facing in the direction opposing the striking piston and with the shank face transferring the feed force from the body through said sleeve bushing to the rotary tool, and means cooperable with the piston cylinder for assisting a pressure medium to be directed towards the front of the piston so that the latter moves backwards toward the striking piston causing a striking contact between an end surface of the shank and the striking piston when the tool becomes stuck.

2. In a striking apparatus including a reciprocating striking operable by a pressure mechanism, a cylindrical body, a sleeve bushing mounted inside of the cylindrical body in slidably fitted assembly therewith, means for driving the sleeve bushing, the improvement comprising a rotary tool and piston shank and piston all integrally combined as a one piece unit and at least partly received in coaxial alignment within said tubular bushing, means between the tubular bushing and the piston shank enabling co-rotational rotary movement together upon being driven, means defining a piston cylinder in the cylindrical body and with the piston being reciprocably movable in the piston cylinder, the shank having a shank face in the direction opposing the striking piston and with the shank face transferring the feed force from the body through said sleeve bushing to the rotary tool, and means cooperable with the piston cylinder for assisting a pressure medium to be directed towards the front of the piston so that the latter moves backwards toward the striking piston causing a striking contact between an end surface of the shank and the striking piston when the tool becomes stuck.

* * * * *